US005607350A

United States Patent [19]

Levasseur et al.

[11] Patent Number: 5,607,350

[45] Date of Patent: Mar. 4, 1997

[54] GLOBAL COIN PAYOUT METHOD AND CONTROL APPARATUS

[76] Inventors: Joseph L. Levasseur, 1605 Timberlake Minor Pkwy., Chesterfield, Mo. 63017; Ronald A. Hoormann, 4 Misty Hollow Ct., St. Charles, Mo. 63303

[21] Appl. No.: 408,061

[22] Filed: Mar. 21, 1995

[51] Int. Cl.[6] ..... G07D 1/06

[52] U.S. Cl. ..... 453/17; 194/217

[58] Field of Search ..... 194/216, 217, 194/218; 453/17

[56] References Cited

U.S. PATENT DOCUMENTS

| | | | |
|---|---|---|---|
| 3,754,629 | 8/1973 | Douglass | 194/201 |
| 3,820,642 | 6/1974 | Levasseur | 194/217 |
| 3,841,456 | 10/1974 | Levasseur | 194/217 |
| 3,963,035 | 6/1976 | Levasseur | 194/216 X |
| 4,188,961 | 2/1980 | Heiman | 194/216 X |
| 4,192,972 | 3/1980 | Bertoglio et al. | 179/6.3 |
| 4,376,478 | 3/1983 | Sugimoto et al. | 194/218 |
| 4,462,512 | 7/1984 | Schuller | 194/217 |
| 4,491,140 | 1/1985 | Eglise et al. | 194/217 X |
| 4,499,982 | 2/1985 | Sugimoto et al. | 194/217 |
| 4,512,454 | 4/1985 | Schuller et al. | 194/346 |
| 4,587,984 | 5/1986 | Levasseur et al. | 453/17 |
| 4,706,202 | 11/1987 | Kobayashi et al. | 364/479 |
| 4,763,769 | 8/1988 | Levasseur | 194/217 |
| 4,883,158 | 11/1989 | Kobayashi et al. | 194/217 |
| 5,092,816 | 3/1992 | Levasseur | 453/17 |
| 5,112,275 | 5/1992 | Sato | 453/17 X |
| 5,184,708 | 2/1993 | Levasseur | 194/217 |
| 5,197,588 | 3/1993 | Furuya et al. | 194/217 |

FOREIGN PATENT DOCUMENTS

| | | | |
|---|---|---|---|
| 2269258 | 2/1994 | United Kingdom | 453/20 |
| 9403875 | 2/1994 | WIPO . | |

*Primary Examiner*—F. J. Bartuska

*Attorney, Agent, or Firm*—Haverstock, Garrett & Roberts

[57] ABSTRACT

A device and method for controlling change payout from a plurality of coin tubes of a vending machine, each of which plurality of coin tubes has a particular coin type stored therein, including a processor for processing data and controlling vend operations, and coin level sensors for indicating the level of coins stored in each of the plurality of coin tubes, the processor programmed to determine the amount of change payback and whether one or more predetermined conditions are satisfied, including whether a first payout routine has been disabled, and if the first payout routine has been disabled, to execute a global payout routine which includes steps to effect an attempt to payout one coin only from a full coin tube, and steps to effect, if a coin is not paid out from a full coin tube, an attempt to payout one coin from a coin tube storing a coin denomination which cannot be evenly divided into the next highest coin denomination stored in one of the plurality of coin tubes.

45 Claims, 4 Drawing Sheets

| | PAYOUT AMOUNT | COIN TUBE STATUS | | | | LEAST COIN PAYOUT ROUTINE | | | | GLOBAL COIN PAYOUT ROUTINE | | | |
|---|---|---|---|---|---|---|---|---|---|---|---|---|---|
| | | $ | Q | D | N | $ | Q | D | N | $ | Q | D | N |
| 1. | 30 ¢ | M | F | F | M | 0 | 1 | 0 | 1 | 0 | 0 | 3 | 0 |
| 2. | 30 ¢ | M | M | M | M | 0 | 1 | 0 | 1 | 0 | 0 | 3 | 0 |
| 3. | 70 ¢ | F | M | F | M | 0 | 2 | 2 | 0 | 0 | 2 | 2 | 0 |
| 4. | $ 1.05 | M | F | F | F | 1 | 0 | 0 | 1 | 0 | 3 | 3 | 0 |
| 5. | $ 1.20 | M | M | M | M | 1 | 0 | 2 | 0 | 1 | 0 | 2 | 0 |

Fig. 4

GLOBAL COIN PAYOUT METHOD AND CONTROL APPARATUS

FIELD OF THE INVENTION

The present invention relates to providing change to customers from vending machines and, more particularly, to a method and apparatus which can be utilized with both U.S. and foreign currencies in improving the mix of preferred coins stored in the coin tubes of such a machine.

BACKGROUND OF THE INVENTION

Vending machines often include change payout apparatus for paying out change to a customer in the event of an excess deposit, i.e., a deposit which exceeds the vend price. Examples of such vending machines are set forth in U.S. Pat. Nos. 3,754,629, 3,820,642, and 3,841,456, all of which are assigned to the present assignee.

In vending machines capable of paying out change in the event of an excessive customer deposit, a plurality of coin tubes generally are utilized for storing coins. Each coin tube is designated to store coins of one denomination, e.g. quarter, nickel, or dime. Initially, an operator fills each coin tube with the designated denomination. In operation, when a customer makes an excess deposit, the amount of change due is determined and paid out from the coin tubes.

To avoid having to frequently manually replenish the coin tubes, a deposited coin is supplemented to coins of the same denomination stored in a coin tube if the coin tube is not full. If the coin tube is full, a deposited coin is routed to a cash box. For example, if the quarter tube is not full, deposited quarters will be routed to the quarter tube. If the quarter tube is full, deposited quarters will be routed to the cash box. Examples of vending machines including coin tubes and routing mechanisms are set forth in U.S. Pat. Nos. 3,963,035, 4,587,984, and 5,184,708, all of which are assigned to the present assignee.

Vending machines also typically include structure to sense the number of coins in each coin tube and to control the payout of change using the highest possible denominations of coins. Lower denomination coins are used if the quantity of coins in the higher denomination coin tubes has fallen below a predetermined level. Paying out change using the highest possible denominations of coins generally is known as a "least coin payout". Paying out change using the highest denomination of coins facilitates maintaining a better "mix" of coins stored in the coin tubes and operating a vending machine for longer periods of time without requiring customers to deposit exact change.

Once the quantity of coins in a coin tube falls to a predetermined level, and if payout of proper change is not possible without a coin from such tube, the vending machine requires an exact deposit equal to the vend price to make a sale. A customer, fully aware that proper change is not possible, could still make an excess deposit and a vend operation would be performed. Under such circumstances, however, the customer will receive a payout less than the difference between the vend price and the amount deposited. Examples of such coin level detection and payout control are set forth in U.S. Pat. Nos. 3,963,035 and 4,587,984, which are mentioned above, and U.S. Pat. No. 4,763,769, which is assigned to the present assignee.

Since many customers often do not have coins readily available to make such an exact deposit, sales usually are lost when a vending machine requires exact deposit. Further, having an operator frequently replenish the coin tubes for each vending machine generally is expensive, particularly when a number of vending machines are located in a large geographic area.

Although the least coin payout method is useful and provides many advantages, there exists a need for maintaining even a better mix of preferred, or more often paid out, coins stored in the coin tubes. For example, one coin denomination may not be paid out as often as other coin denominations, even though such one coin denomination is available and could be used. As a result, the coin tube for the one denomination remains full as other coin tubes storing the preferred coins are depleted.

Attempts to maintain a better mix of preferred coins stored in the coin tubes include payout systems which generate and evaluate a plurality of alternative payout combinations. Specifically, using alternative payout methodologies, alternative payout combinations or arrays are generated. One payout combination is then selected, based on, for example, which combination is "best", for making the actual payout. A hierarchy of rules may be utilized to determine which combination is "best". An example of such a system is described in PCT Patent Application WO 94/03875, published February 17, 1994. Such systems which generate alternative payout combinations and then select one combination to make the actual payout are complex, certainly as compared to routines which only make a payout using the least coin payout method. The more complex routines are more difficult to implement and are more susceptible to errors. Such routines also require more memory storage, which typically increases the cost of the systems.

Known payout routines also typically are optimized for a particular currency. For example, one payout routine may optimize coin mixes for vending machines accepting U.S.A. currency. For a foreign currency, however, the same routine may not optimize the coin mix. Rather than having to use different payout routines for each currency type, it is preferable to simply use one routine for all currencies.

Accordingly, it is desirable and advantageous to provide a vending machine capable of paying out change for long periods of time without requiring an operator to manually replenish the coin tubes. It is also desirable and advantageous to provide a change payout routine which can be used with many different currencies, is easy to implement, does not require excessive memory yet controls operations so as to maintain a better mix of preferred coins stored in the coin tubes of a vending machine.

An object of the present invention is to provide a vending machine capable of paying out change for long periods of time without requiring an operator to manually replenish the coin tubes.

Another object of the present invention is to provide a vending machine which provides an accurate payout to a customer and operates to facilitate preventing the quantity of coins for each coin type stored in the machine coin tubes from falling below a predetermined level.

Yet another object of the present invention is to provide a change payout routine which can be used with many different currencies, is easy to implement, does not require excessive memory, and controls operations so as to maintain a better mix of preferred coins stored in the coin tubes.

SUMMARY OF THE INVENTION

These and other objects of the invention are obtained in an assembly constructed and a method implemented in accordance with the present invention. In carrying out the various objects of the present invention in one form thereof, a microprocessor-based vending machine is provided, such as the machine described in U.S. Pat. No. 4,763,769, which is assigned to the present assignee. The machine includes processing means and a plurality of coin tubes.

Coin tube status means, which may include coin level sensors, determine the level of coins stored in each tube. A minimum level sensor, for example, is utilized to determine whether the coin level in an associated tube is at or above such minimum level. Similarly, an uppermost sensor is utilized to determine whether an associated tube is full. Alternative coin level monitoring can be implemented in accordance with the monitor described in U.S. Pat. No. 4,587,984.

After a deposit is made in the vending machine, the amount of change due, if any, is determined by the processing means. If change is due, i.e., a payout is to be made, the processing means sets the total amount of the payout equal to $CHANGE_{TOT}$.

The processing means then checks the status flags for certain conditions to determine whether to execute the present global payout routine. Particularly, if the least coin payout routine (LCPR) has been disabled, then the global payout routine will be executed. The LCPR can be disabled through a user controlled display or by utilizing software tools. If the LCPR is not disabled, then the payout will be made using a routine other than the present global payout routine, such as a "pure" LCPR.

If the LCPR is disabled, then the payout will be made in accordance with the following routine. Specifically, an attempt is made to pay out one coin having a value less than or equal to $CHANGE_{TOT}$ and stored in a coin tube that is full. If more than one such coin tube is full, then as between a payout of one coin from such tubes, the highest denomination coin is paid out. Preferably, only the tubes storing the two (2) lowest value coin denomination types are utilized in executing this step.

If a coin is paid out in accordance with the above step, then $CHANGE_{TOT}$ is updated to equal $CHANGE_{TOT}$- (Value of Coin Paid Out). The remaining amount of change due, i.e., the updated $CHANGE_{TOT}$, is then paid out using the least coin payout routine.

If a coin is not paid out in accordance with the foregoing, (i.e., no coin tube storing a coin type satisfying the above stated conditions is full), then the coin levels in each coin tube storing one of the three lowest coin denomination types is checked to determine whether such levels are at least equal to a minimum coin level. If such coin tubes have at least the minimum level of coins stored therein, then one coin having a value less than or equal to $CHANGE_{TOT}$ is paid out from the coin tube storing the lowest coin denomination type which cannot be evenly divided into the next highest value coin denomination type. After one such coin type is paid out, $CHANGE_{TOT}$ is updated to equal $CHANGE_{TOT}$- (Value of Coin Paid Out). The remaining amount of change due, i.e., the updated $CHANGE_{TOT}$, is then paid out using the least coin payout routine.

If any one of such coin tubes does not have the minimum level of coins, or even if such tubes do have the minimum level of coins but no coin is paid out as specified, then the total payout is made using an alternative payout routine. For example, $CHANGE_{TOT}$ could be paid out using a "pure" LCPR.

By making a payout in accordance with the foregoing, the vending machine pays out, when possible, at least one coin from a full coin tube or from a coin tube which is less likely to be selected for making the payout using the least coin payout routine. Such a payout results in saving coins which are more likely, as compared to other coin types in the machine, to first reach a condition in which further payout of such coin type is not possible. Further, by paying out at least one such coin, a better mix of preferred coins is maintained in the coin tubes, which facilitates paying out change for long periods of time without requiring an operator to manually replenish the coin tubes. The above described payout routine also is easy to implement and does not require excessive memory. Further, and importantly, the above described payout routine can be used with, and facilitates maintaining a better coin mix of preferred coins of, different currencies including U.S.A. and foreign currencies.

BRIEF DESCRIPTION OF THE DRAWINGS

FIG. 4 is a table illustrating various payouts.

DETAILED DESCRIPTION OF THE DRAWINGS

Figure 1:
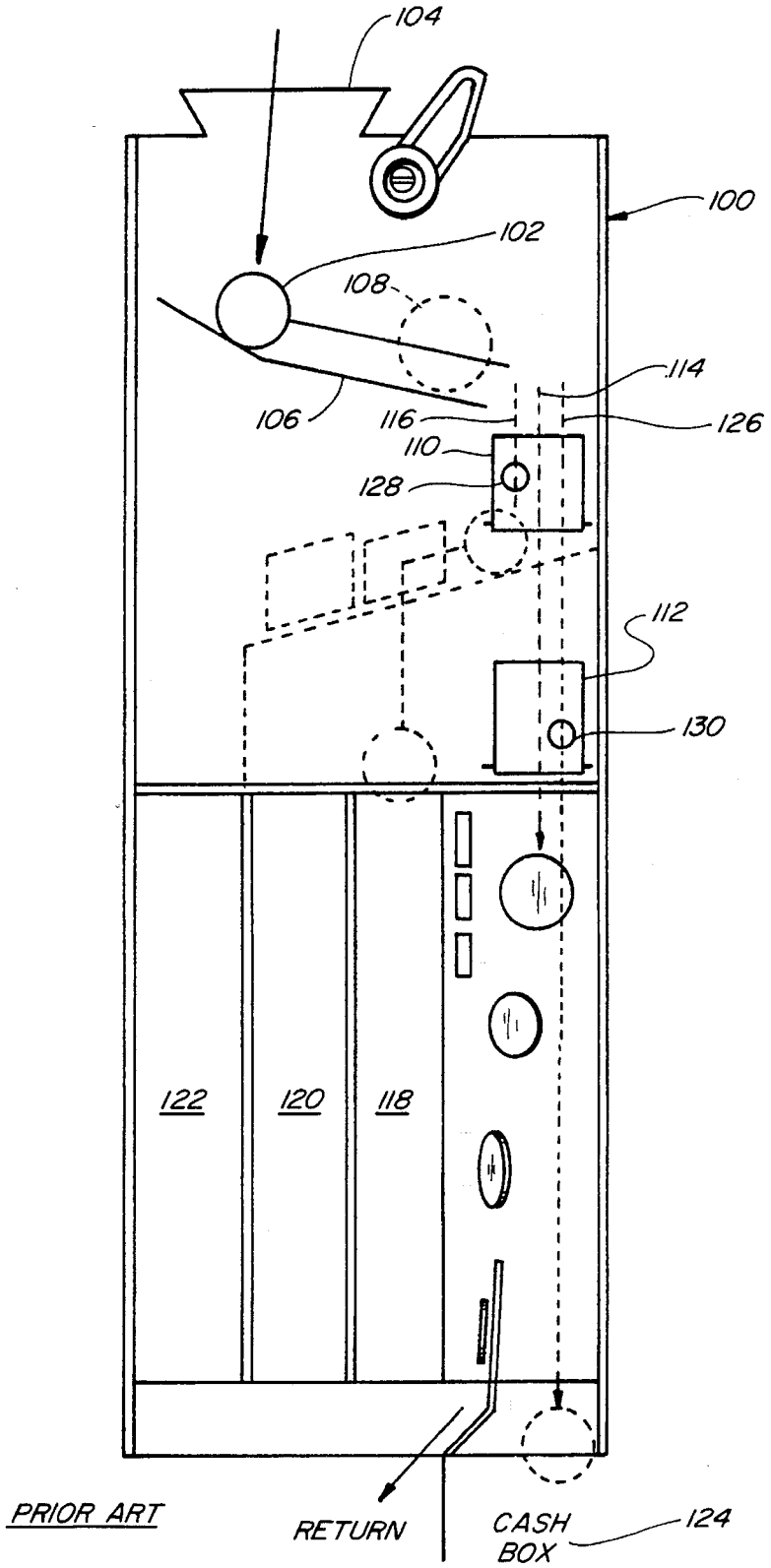
FIG. 1 is a diagrammatic depiction of a typical coin changer unit depicting in simplified form various possible coin paths in and/or through such unit.

A coin changer unit 100 of the type typically employed in many existing vending systems is illustrated in FIG. 1. Coins, such as coin 102, may be deposited at coin inlet 104, and they thereafter move along a coin path 106, which path may include means of various types for mechanically sizing coins and separating certain kinds of slugs from among the coins deposited, to pass by and/or interact with a coin analysis or sensing means 108 that is operable to produce coin analysis data pertinent to such coin. Numerous types of coin analysis means and coin sensing means are known to those skilled in the art, any number of which means might be equally and advantageously used in vending systems constructed to include the coin payout control means of the present invention. Typical of some of such known coin analysis means and sensing means are constructions disclosed in U.S. Pat. Nos. 4,763,769 and 5,092,816, both of which are assigned to the present assignee and hereby incorporated herein by reference.

Depending upon whether either of the controllably operable diverters or gates 110 or 112 are operated, the coin may thereafter be caused to follow one of several different possible paths. If neither gates 110 or 112 are operated, the coin will follow path 114 to be returned to the customer. If gate 110 is operated, the coin will follow path 116 and, depending upon its denomination, will be directed into dime coin tube 118, nickel coin tube 120, quarter coin tube 122, or, if the appropriate coin tube is filled, will be caused to fall to the front or rear of the coin tubes or otherwise be directed into a coin collection or cash box 124. If gate 112 is operated instead of gate 110, e.g., as in the case of a deposit of a validated and accepted dollar coin, the coin will follow path 126 and be directed into cash box 124. Sensing means, such as sensing means 128 and sensing means 130, may be positioned to detect movement of the deposited coin past or through an appropriate gate or along an appropriate path and to produce sensor signals indicative of such coin detection.

Figure 2:
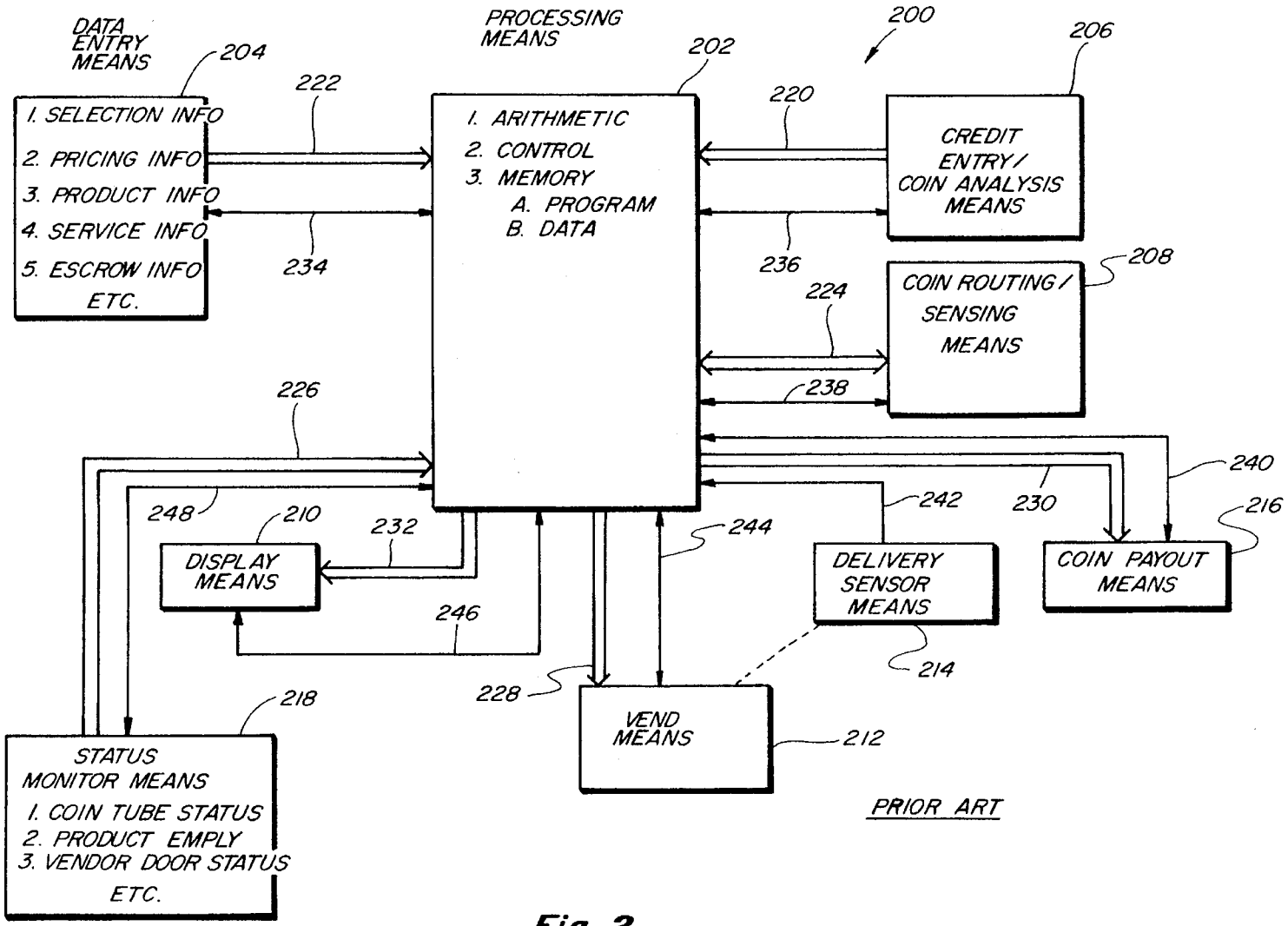
PRIOR ART Fig. 2
FIG. 2 is a block diagram of a vending system embodiment including a programmed microprocessor.

FIG. 2 illustrates, in block form, a microprocessor controlled vending system 200 that includes a processing means 202, data entry means 204, credit entry/coin analysis means 206, coin routing/sensing means 208, display means 210, vend means 212, delivery sensor means 214, coin payout means 216, and status monitor means 218. Processing means 202 includes memory means as well as arithmetic and control means typical of a microprocessor controlled vending system.

In system 200, coin analysis data may be supplied from the credit entry/coin analysis means 206 to the processing means 202 by means of a data path 220. Data information of various types, including selection information, pricing information, product information, and service information, may be provided from data entry means 204 to processing means 202 by means of a data path 222. Coin routing/sensing data may be provided from coin routing/sensing means 208 to processing means 202 by means of a data path 224. Status data, including coin tube status information, product empty information, and vendor status information, may be provided from status monitor means 218 to processing means 202 by means of a data path 226. Data for vend purposes may be provided from processing means 202 to vend means 212 by way of data path 228. Coin payout data may be provided from processing means 202 to coin payout means 216 by way of data path 230, and information for display may be communicated from processing means 202 to display means 210 by means of data path 232. Various control and status signals may be intercommunicated among the components of the microprocessor controlled vending system means of signal paths 234, 236, 238, 240, 242, 244,246, and 248.

System 200 could be coupled to changer unit 100 (FIG. 1), with certain components in unit 100 forming part of the means illustrated in block form in FIG. 2. For example, credit entry/coin analysis means 206 could be formed, in part, by means 108. Coin routing/sensing means 208 could be formed, in part, by gates 110 and 112. The coin tube status monitor of monitor means 218 could be coupled to coin tubes 118, 120 and 122 and include counters and coin level detectors spaced along each coin tube.

With respect to coin levels, coin level sensors typically are associated with each coin tube 118, 120 and 122. The coin level sensors are utilized to provide an indication as to the quantity of coins stored in each tube. More specifically, coin level sensors are place along the length of each coin tube. Processing means 202 (FIG. 2) obtains data related to the level of coins stored in each such tube. For example, depending on whether the coins in a particular tube are covering or not covering a portion of the tube adjacent a sensor, such sensor produces a "high" or a "low" signal. By reading the output signals from each sensor, the level of coins in each tube can be determined. Typically, a lowermost sensor provides an indication as to whether the quantity of coins in the associated tube has fallen to a minimum level, e.g., a level at which no further payout from such tube should be made until the tube is replenished (i.e., the minimum level). An uppermost sensor provides an indication as to whether the associated tube is full.

Of course, there are many alternative structures and methods for determining the level or quantity of coins stored in the vending machine coin tubes. One example of such an alternative is set forth in U.S. Pat. 4,587,984. As used herein, the term "level" means the height of the coin stack in a coin tube, the quantity of coins in the tube, or at least some indication as to the number of coins in the tube. The present invention is not limited to any particular apparatus or method for determining coin level.

Also, coin changer unit 100 (FIG. 1) and microprocessor controlled vending system 200 (FIG. 2) illustrate only one of many changer units and vending systems. It will be readily apparent that many other changer units and vending systems might be equally well utilized in connection with the improved payout routine described below.

As explained above, it is desirable to implement one routine which optimizes the mix of coins stored in the coin tubes for many different currencies. Typical currencies accepted by vending machines are the currencies of the U.S.A., France, Japan, the United Kingdom, and Korea. Table 1, set forth below, illustrates such currencies on the basis of a ratio. Specifically, the base coin for each currency has a coin ratio of "1" The values of other coins of the same currency are indicated based on their ratio to the base coin, e.g., a quarter (25 cents) has a coin ratio of five (5) since the base coin for U.S. currency is a nickel (5 cents). If there is no single coin/currency for a particular ratio, the value "[uneven]" is indicated.

TABLE 1

| Coin Ratio | U.S. | Germany | France | France |
|---|---|---|---|---|
| 1 | 5 cents | 10 pfennig | 10 centimes | ½ franc |
| 2 | 10 cents | | 20 centimes | 1 franc |
| 4 | [uneven] | | [uneven] | 2 francs |
| 5 | 25 cents | 50 pfenning | ½ franc | [uneven] |
| 10 | 50 cents | 1 mark | 1 franc | 5 francs |
| 20 | 1 dollar | 2 marks | 2 francs | 10 francs |
| 40 | 2 dollars | [uneven] | [uneven] | |
| 50 | [uneven] | 5 marks | 5 francs | |
| 100 | 5 dollars | | 10 francs | |

| Coin Ratio | Japan | U.K. | U.K. | Korea |
|---|---|---|---|---|
| 1 | 10 yen | 1 pence | 5 pence | 10 won |
| 2 | | | 10 pence | |
| 4 | | | 20 pence | |
| 5 | 50 yen | 5 pence | [uneven] | 50 won |

TABLE 1-continued

| | | | | |
|---|---|---|---|---|
| 10 | 100 yen | 10 pence | 50 pence | 100 won |
| 20 | | 20 pence | 1 pound | |
| 40 | | [uneven] | | |
| 50 | 500 yen | 50 pence | | 500 won |
| 100 | | 1 pound | | |

Although only limited currencies are illustrated above in Table 1, it should be understood that many other currencies could be utilized in a vending machine and with the present invention.

Figure 3:
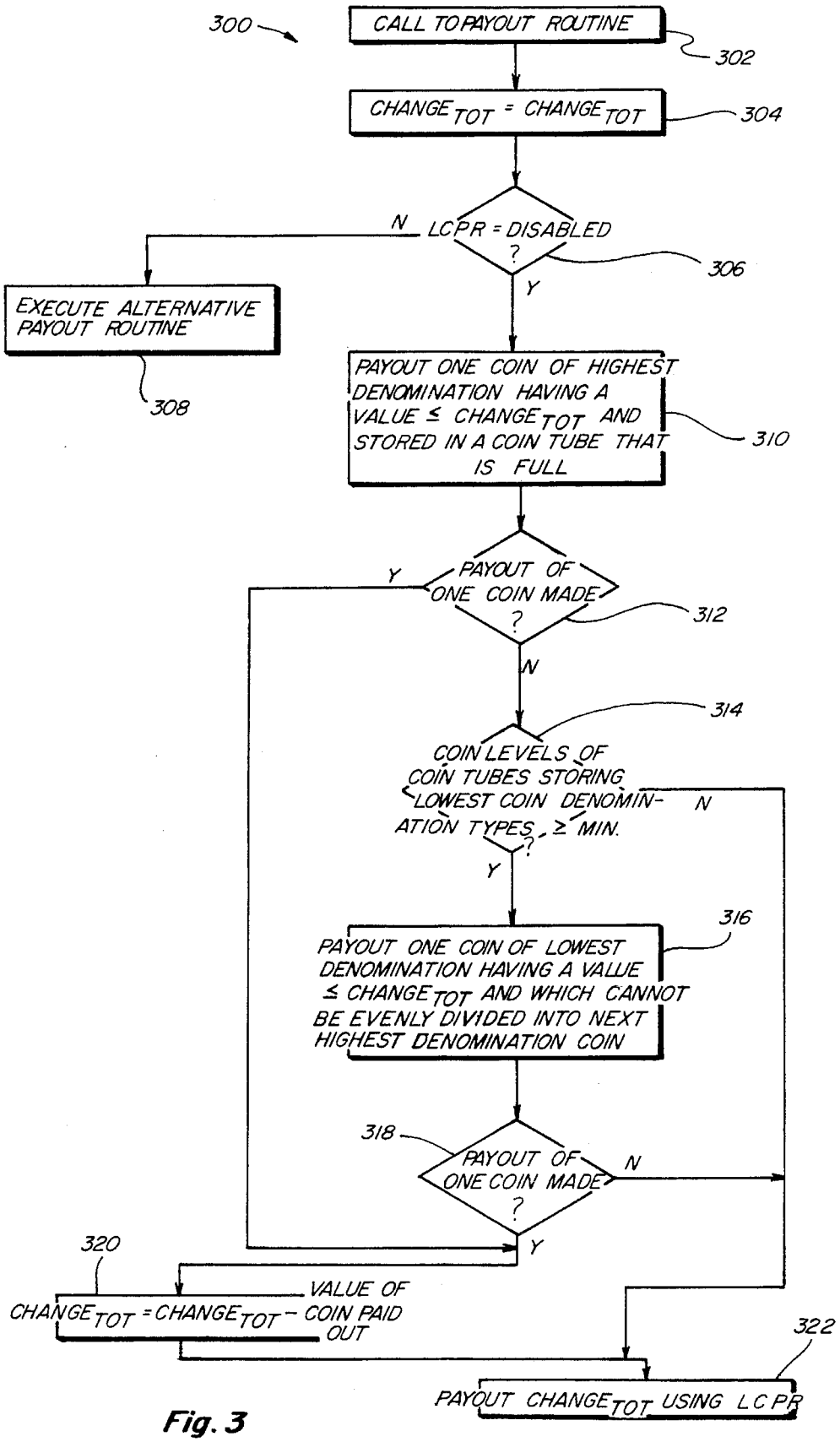
FIG. 3 is a flow chart illustrating one embodiment of a sequence of process steps for a global payout routine that may be utilized with the vending machine system illustrated in FIG. 2.

FIG. 3 is a flow chart 300 illustrating a sequence of process steps in accordance with one embodiment of the present global coin payout routine. The process steps would, for example, be executed by processing means 202 controlled by a resident control program, often firmware. Many variations are possible, and many routines could be used in combination with such steps.

Referring now particularly to flow chart 300, once the payout routine is called as indicated at a step 302, processing means 202 determines the amount of change to be paid out at a step 304. Particularly, by subtracting the amount deposited by a customer from the vend price of the item selected by the customer, the total change ($CHANGE_{TOT}$) to be paid out is determined. Alternative ways to determine $CHANGE_{TOT}$ are described in U.S. Pat. Nos. 4,763,769 and 5,184,708.

Once a value for $CHANGE_{TOT}$ is determined, the least coin payout routine ("LCPR") status flag is scanned to determine whether such routine is DISABLED. Disabling the LCPR could be performed at the factory by setting a switch or setting a flag in the system memory. Alternatively, the LCPR could be disabled in the field using software tools.

If the LCPR is not disabled, then as illustrated at a step 308, an alternative payout routine (e.g., a "pure" least coin payout routine) is executed for making the payout. If LCPR is disabled, however, processing continues to a step 310.

At step 310, one coin having the highest value denomination but having a value less than or equal to $CHANGE_{TOT}$ and stored in a coin tube that is full is paid out. In executing this step, preferably only the coin tubes storing the two (2) lowest coin denomination types are considered, e.g., for U.S.A. currencies, only the nickel and dime coin tube are considered.

If no coin is paid out at step 310, then processing proceeds through decision block 312 to step 314. At step 314, the coin levels of the coin tubes storing the three lowest coin denomination types is checked to determine whether such coin levels are greater than or equal to a minimum level. As described above, coin level sensors or other apparatus and methods can be used to make such determination. If the coin levels in each coin tube storing the three lowest coin denomination types are at the minimum level (e.g., covering the lowermost sensors), then as indicated at a step 316, one coin having a value less than or equal to $CHANGE_{TOT}$ is paid out from the coin tube storing a coin denomination type which cannot be evenly divided into the next highest value coin denomination type. For example, if this step 316 in the routine is reached and the machine has nickel, dime and quarter coin tubes, a dime cannot be evenly divided into a quarter. Therefore, if the payout amount is thirty cents, a dime would be paid out at step 316.

If a coin is paid out at steps 310 or 316, then processing proceeds through decision block 312 or 318, respectively, to a step 320, at which $CHANGE_{TOT}$ is updated to equal the value of $CHANGE_{TOT}$ minus the value of the coin paid out. Once $CHANGE_{TOT}$ is so updated, processing proceeds to a step 322 where the updated value of $CHANGE_{TOT}$ is paid out using the least coin payout routine or possibly some other routine.

If no coin is paid out at either steps 310 or 316, then $CHANGE_{TOT}$ is paid out using an alternative payout routine, such as a "pure" LCPR.

The global payout routine, as is evident from the above description, facilitates enabling a vending machine to pay out change for long periods of time without requiring an operator to manually replenish the coin tubes. This result is provided by paying out, when possible, at least one appropriate coin from a full coin tube or from a coin tube that is less likely to be designated for payout using a "pure" LCPR. Such payout control also facilitates maintaining a better mix of preferred coins stored in the coin tubes to provide accurate payouts to customers for longer periods of time. Importantly, the present routine can be used in connection with U.S.A. and foreign currencies.

To provide further illustration of the global payout routine, a table illustrating various payouts is set forth in FIG. 4. With respect to the vertical columns, the "Payout Amount" column refers to the amount to be paid out from the vending machine. The "Coin Tube Status" ($-dollar, Q-quarter. D-dimes, N-nickel) column refers to the types of coins contained in the vending machine and the tube status for such coin tubes (M=minimum level; F=full). The "Least Coin Payout Routine" column identifies the quantity of coins for each coin type that would be paid out using a "pure" least coin payout. The "Global Coin Payout Routine" column identifies the quantity of coins for each coin type that would be paid out when executing the process steps illustrated in flow chart 300 of FIG. 3. As described in connection with flow chart 300 as the preferred routine, and in the following examples, at step 310 only the coin tubes storing the two (2) lowest coin denomination types are considered. The "Least Coin Payout Routine" column is illustrated for comparison purposes only. Further, for purposes of illustration, it is assumed that LCPR is disabled (see step 306 of flow chart 300).

Referring to Payout No. 1 in FIG. 4, the amount to be paid out is thirty cents. The vending machine has dollar, quarter, dime and nickel coin tubes. The dollar and nickel coin tubes are not full but have coin levels at or above the minimum level. The quarter and dime coin tubes are full (F). For such a payout, the least coin payout routine would payout one quarter and one nickel.

With the Global Coin Payout Routine, since the dime tube is full and could be used in making a payout, a dime is initially paid out (step 310). $CHANGE_{TOT}$ is then set to equal $0.30_{¢}$–$0.10_{¢}$, or $0.20_{¢}$ (step 320). Using the Least Coin Payout Routine, or LCPR, to payout the updated $CHANGE_{TOT}$, two additional dimes are paid out (step 322). The global payout routine saved one quarter and, more importantly, one nickel for future payout.

With respect to Payout No. 2, the same Payout Amount and coin tubes are available as in Payout No. 1 except that no coin tubes are full. The Least Coin Payout Routine would payout, as before, one quarter and one dime.

With respect to the Global Coin Payout Routine, however, since no coin tube is full, processing would proceed to step 314. Since the quarter, dime and nickel tubes have at least a minimum level of coins, the lowest value coin which does not evenly divide into the next highest coin type is paid out. In this instance, a dime is paid out (step 316). $CHANGE_{TOT}$ is then updated to equal $0.30_{¢}-0.10_{¢}$, or $0.10_{¢}$ (step 320). Using the LCPR, the updated $CHANGE_{TOT}$ is paid out using two additional dimes (step 322).

In Payout No. 3, the Payout Amount is seventy cents. The dollar and dime tubes are full. The quarter and nickel tubes are not full but have at least a minimum level of coins. Although the dollar coin tube is full, a dollar coin cannot be paid out since it has a value greater than $CHANGE_{TOT}$. The dime coin tube, however, also is full and one dime is paid out. $CHANGE_{TOT}$ is then sent to equal $0.70_{¢}-0.10_{¢}$, or $0.60_{¢}$. Using the LCPR, the updated value of $CHANGE_{TOT}$ is paid out with two quarter coins and one dime coin. The pure LCPR results in an identical payout, albeit made in a different sequence from highest coin to lower coins.

In Payout No. 4, the Payout Amount is one dollar and five cents. The quarter, dime and nickel coin tubes are full. The dollar coin tube is not full but has the minimum level of coins therein. At step 310, and in accordance with the Global Coin Payout Routine, one dime coin would be paid out. Note that only the nickel and dime tubes are considered at step 310. Even though the quarter tube is full, the quarter tube is not considered at step 310. After payout of one dime, $CHANGE_{TOT}$ would be set to equal $0.95_{¢}$ (step 320) and then three quarters and two additional dimes would be paid out (step 322). Using a "pure" LCPR, one dollar coin and one nickel coin would be paid out. The Global Coin Payout Routine therefore resulted in saving one dollar coin for future payout.

In Payout No. 5, the Payout Amount is one dollar and twenty cents and no coin tubes are full. Therefore, in Payout No. 5, and with respect to the Global Coin Payout Routine, processing proceeds to step 316 where one dime would be paid out. Then, at step 320, $CHANGE_{TOT}$ is updated to equal $\$1.20-0.10_{¢}$, or $\$1.10$. $CHANGE_{TOT}$ is then paid out using one dollar coin and one dime coin at step 322.

The payouts set forth in the table of FIG. 4 illustrate various payouts and provide a comparison between the payouts made using the "pure" least coin payout routine and the present global payout routine. As shown in FIG. 4, the present routine results in saving when appropriate, coins from tubes which typically are the "preferred" coins and pays out coins which are used less often, certainly as compared to the least coin payout routine. For example, in the table illustrated in FIG. 4, the Global Coin Payout Routine did not payout even one nickel in any of the five payouts whereas the least coin payout routine paid out three nickels, in total, for the payouts. By saving nickels, which can be used in making all payouts, the Global Coin Payout Routine maintains a better mix of the preferred coins in the coin tubes.

Although the various embodiments of the improved payout routine have been described herein in specific forms thereof, many variations of such routine are contemplated and possible. For example, if a plurality of coin tubes are utilized for storing a same coin type, e.g., two nickel coin tubes, then the coin levels associated with such coin tubes could be added together to provide a level for such coin type.

Also, rather than using coin sensors at steps 310 and 316, a coin count or coin ratio could be generated for each coin type. For example, if a coin ratio is to be determined, the coin tube status monitoring means would include two counters associated with each coin tube. With respect to each coin tube, a first counter is incremented each time a coin is deposited in the tube and a second counter is incremented each time a coin is paid out from the tube. The processing means determines a coin ratio by dividing the value of the first counter by the value of the second counter, i.e., coins in/coins out. If a plurality of tubes are used to store a same coin type, the coin ratios could be combined to provide a total coin ratio.

Further, rather than using coin tube status data, coin type data could be utilized in executing steps 310 and 316. For example, if a vending machine has three coin tubes for each coin denomination type, the quantity of each coin type rather than the status of each coin robe could be used to determine which coin to payout at step 310, e.g., rather than requiring that a coin tube be full, require that the quantity of coins in the machine exceed a predetermined level.

Moreover, the condition set forth in decision block 306 for determining whether to proceed to step 310 may vary from machine to machine, depending upon the specific machine configuration and operation. The condition set forth at step 306 is for illustration purposes only.

The global payout routine as set forth above can be utilized in connection with many different currencies, is easy to implement and is much less complex than routines which create a number of alternative payout combinations and then select the "best" combination for an actual payout. Further, by paying out coins in accordance with the present routine, coins which are more likely, as compared to other coin types, to be depleted are saved. As a result, a better mix of preferred coins is maintained in the coin tubes and the vending machine may payout change for long periods of time without requiring an operator to manually replenish the coin tubes.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. The various described processing steps, for example, could be modified in many ways and still achieve the objectives of the present invention Accordingly, the spirit and scope of the invention are to be limited only by the terms of appended claims.

What is claimed is:

1. A device for controlling change payout in a vending machine capable of being configured to execute a least coin payout, the vending machine including vend means, a plurality of coin tubes, each coin tube having one coin denomination type stored therein, and means for indicating whether each coin tube is full, wherein a coin may still be paid out from a coin tube which is not full, said device comprising processing means operably connectable to the vending machine for processing data therefrom and controlling the vend means, said processing means programmed to determine the amount of change ($CHANGE_{TOT}$) desired to be paid out during a vend operation and whether at least one predetermined condition is satisfied for a particular vend, said processing means further programmed to execute a global payout routine, if said predetermined condition is satisfied and independent of the least coin payout, wherein, one portion of said global payout routine effects an attempt to payout one coin having a value less than or equal to $CHANGE_{TOT}$ and selected from a coin tube that is full and another portion of said global payout routine effects an attempt to payout one coin having a value less than or equal to $CHANGE_{TOT}$ and selected from a coin tube storing a coin type having a value which cannot be evenly divided into the next highest coin denomination type.

2. A device in accordance with claim 1 wherein in attempting to payout one coin having a value less than or equal to $CHANGE_{TOT}$ and selected from a coin tube that is full said processing means is programmed to evaluate only the coin tubes storing the two lowest coin denomination types to determine whether such coin tubes are full.

3. A device in accordance with claim 2 wherein in attempting to payout one coin having a value less than or equal to $CHANGE_{TOT}$ and selected from a coin tube that is full said processing means is programmed to select for payout one coin from an evaluated coin tube, the one coin selected for payout being the highest coin denomination type stored in an evaluated coin tube that is full.

4. A device in accordance with claim 2 wherein in attempting to payout one coin having a value less than or equal to $CHANGE_{TOT}$ and selected from a coin tube storing a coin type having a value which cannot be evenly divided into the next highest coin denomination type said processing means is further programmed to identify, after evaluating the coin tubes storing the two lowest coin denomination types, and if no such coin tube is full, a coin denomination type having a value less than or equal to $CHANGE_{TOT}$, and which cannot be evenly divided into the next highest coin denomination type.

5. A device in accordance with claim 4, further comprising means for indicating whether or not each coin tube contains a minimum coin level, wherein prior to attempting to payout one coin having a value less than or equal to $CHANGE_{TOT}$ and selected from a coin tube storing a coin type having a value which cannot be evenly divided into the next highest coin denomination type, said processing means is programmed to check whether the coin tubes storing the three lowest coin denomination types have a coin level at least equal to a minimum coin level.

6. A device in accordance with claim 5 wherein if each of the coin tubes storing the three lowest coin denomination types do not have a coin level at least equal to a minimum coin level, then no attempt is made to payout one coin having a value less than or equal to $CHANGE_{TOT}$ selected from a coin tube storing a coin type having a value which cannot be evenly divided into the next highest coin denomination type.

7. A device in accordance with claim 1 wherein said predetermined condition is that the least coin payout routine be disabled.

8. A device in accordance with claim 1 wherein if said predetermined condition is not met, then said processing means is programmed to payout change using an alternative payout routine.

9. A device in accordance with claim 8 wherein the alternative payout routine is a least coin payout routine.

10. A device in accordance with claim 1 wherein said processing means is programmed to perform, after first paying out one coin from a full coin tube, or a coin type having a value which cannot be evenly divided into the next highest coin denomination type, the steps of:

set $CHANGE_{TOT}$ equal to $CHANGE_{TOT}$ minus the value of the one coin paid out; and payout $CHANGE_{TOT}$ using a preprogrammed payout routine.

11. A device in accordance with claim 10 wherein the preprogrammed payout routine is a least coin payout routine.

12. A device in accordance with claim 1 wherein said processing means is programmed to payout $CHANGE_{TOT}$ using a preprogrammed payout routine if said at least one predetermined condition is met and if no coin is paid out after attempting to payout one coin having a value of less than or equal to $CHANGE_{TOT}$ and selected from a coin tube that if full and if no coin is paid out after attempting to payout one coin having a value less than or equal to $CHANGE_{TOT}$ and selected from a coin tube storing a coin type having a value which cannot be evenly divided into the next highest coin denomination type.

13. Apparatus for controlling change payout in a vending machine having a plurality of coin tubes, each coin tube having one coin denomination type stored therein, at least one coin level sensor associated with each coin tube for generating a signal indicative of the coin tube being full, wherein a coin may still be paid out from a coin tube which is not full, said apparatus comprising a processor for processing data and controlling vend operations, said apparatus configured, for each change payout operation, to:

(a) determine the amount of change ($CHANGE_{TOT}$) desired to be paid out during a vend operation; and (b) determine, based upon one or more signals from the vending machine, whether at least one predetermined condition is satisfied for a particular vend, and if said at least one predetermined condition is satisfied, to:

(i) determine if at least one coin tube is full and, if so, to identify at least one full coin tube storing a coin denomination type having a value less than or equal to $CHANGE_{TOT}$, if such a full coin tube exists;

(ii) if at least one coin tube is identified at step (b) (i), first effect payout of one coin from a coin tube identified at step (b) (i); and (iii) if no coin tube is identified at step (b) (i), attempt to payout one coin having a value less than or equal to $CHANGE_{TOT}$ and having a value which cannot be evenly divided into the next highest value coin type.

14. Apparatus in accordance with claim 13 wherein in performing step (b) (i), only the coin tubes storing the two lowest coin denomination types are considered in identifying at least one full coin tube storing a coin denomination type having a value less than or equal to $CHANGE_{TOT}$.

15. Apparatus in accordance with claim 14 wherein if more than one coin tube is identified at step (b) (i), then the one coin paid out at step (b)(ii) is the highest coin denomination type stored in an identified coin tube.

16. Apparatus in accordance with claim 13 wherein in performing step (b) (iii) said apparatus is configured to identify at least one coin tube storing a coin denomination type having a value which cannot be evenly divided into the next highest value coin type, and if more than one coin tube is identified as storing a coin denomination type which cannot be evenly divided into the next highest value coin type, and if more than one of the coin denomination types stored in one of the identified coin tubes has a value less than or equal to $CHANGE_{TOT}$, the one coin paid out is the lowest denomination coin type stored in an identified coin tube.

17. Apparatus in accordance with claim 13, further comprising at least one coin level sensor associated with each coin tube for generating a signal indicative of the coin tube having a predetermined minimum level of coins stored therein, wherein step (b) (iii) is performed only if the coin levels in the coin tubes storing the three lowest coin denomination types are at least at said predetermined minimum levels.

18. Apparatus in accordance with claim 13 wherein said predetermined condition at least includes the condition that the least coin payout routine be disabled.

19. Apparatus in accordance with claim 13 wherein said apparatus is configured to payout change using an alternative payout routine if said predetermined condition is not met.

20. Apparatus in accordance with claim 19 wherein the alternative payout routine is a least coin payout routine.

21. Apparatus in accordance with claim 13 wherein said apparatus, after paying out one coin in accordance with step (b) (ii) or step (b) (iii), is configured to:

(c) set $CHANGE_{TOT}$ equal to $CHANGE_{TOT}$ minus the value of the one coin paid out; and (d) payout $CHANGE_{TOT}$ using a preprogrammed payout routine.

22. Apparatus in accordance with claim 21 wherein the preprogrammed payout routine is a least coin payout routine.

23. Apparatus in accordance with claim 13 wherein said apparatus, if no coins are paid out in accordance with step (b) (ii) or step (b) (iii), is configured to payout $CHANGE_{TOT}$ using a preprogrammed payout routine.

24. Apparatus in accordance with claim 23 wherein the preprogrammed payout routine is a least coin payout routine.

25. A method of paying out change from a vending machine, the vending machine having a plurality of coin tubes, each coin tube having one coin denomination type stored therein, the vending machine further including means for determining if each of said coin tubes is full, wherein a coin may still be paid out from a coin tube which is not full, wherein, for each change payout operation, said method comprises the steps of:

(a) determining the total amount of change payout ($CHANGE_{TOT}$) required;

(b) determining if one or more predetermined conditions are satisfied; and (c) if each of said one or more predetermined conditions is satisfied:

(i) identifying, if possible, at least one coin tube which is both:

(a) full: and (b) storing a coin denomination type having a value less than or equal to $CHANGE_{TOT}$;

(ii) if at least one coin tube is identified at step (c) (i), first effecting payout of one coin from an identified coin tube; and (iii) if one coin is not paid out at step (c) (ii), attempting to payout one coin having a value less than or equal to $CHANGE_{TOT}$ and having a value which cannot be evenly divided into the next highest value coin type which is stored in a coin tube.

26. A method in accordance with claim 25 wherein in performing step (c) (i), only the coin tubes storing the two lowest coin denomination types are considered in identifying at least one full coin tube storing a coin denomination type having a value less than or equal to $CHANGE_{TOT}$.

27. A method in accordance with claim 26 wherein if more than one coin tube is identified at step (c) (i), then the one coin paid out at step (c) (ii) is the highest coin denomination type stored in an identified coin tube.

28. A method in accordance with claim 25 wherein in performing step (c) (iii) said apparatus identifies at least one coin tube having a value which cannot be evenly divided into the next highest value coin type, and if more than one coin tube is identified as having a value which cannot be evenly divided into the next highest value coin type, and if more than one of the coin denomination types stored in one of the identified coin tubes has a value less than or equal to $CHANGE_{TOT}$, the one coin paid out is the lowest denomination coin type stored in an identified coin tube.

29. A method in accordance with claim 25 wherein the vending machine further includes means for determining if each of the coin tubes contains a predetermined minimum level of coins and step (c) (iii) is performed only if the coin levels in the coin tubes storing the three lowest coin denomination types are at least at the predetermined minimum levels.

30. A method in accordance with claim 25 wherein before executing step (c), step (b) is executed, said one or more predetermined conditions at least including the condition that the least coin payout routine be disabled.

31. A method in accordance with claim 30 wherein an alternative payout routine is executed if each of said one or more predetermined conditions of step (b) is not met.

32. A method in accordance with claim 31 wherein the alternative payout routine is a least coin payout routine.

33. A method in accordance with claim 25 wherein after paying out one coin in accordance with steps (c) (ii) or (c) (iii), said method further comprises the steps of:

(d) setting $CHANGE_{TOT}$ equal to $CHANGE_{TOT}$ minus the value of the one coin paid out; and (e) paying out $CHANGE_{TOT}$ using a preprogrammed payout routine.

34. A method in accordance with claim 33 wherein the preprogrammed payout routine is a least coin payout routine.

35. A method in accordance with claim 25 wherein if no coin is paid out at steps (c) (ii) or (c) (iii), $CHANGE_{TOT}$ is paid out using a preprogrammed payout routine.

36. A method in accordance with claim 35 wherein the preprogrammed payout routine is a least coin payout routine.

37. A device for controlling on a preferred basis the payout of a first coin from a vending system having at least three coin tubes, which coin tubes have an ordered set of coin denominations associated therewith, each of which coin tubes has a particular coin denomination associated therewith, and coin payout means, said device comprising a processor for processing signals from the vending system so as to monitor the status of coins in at least certain of said coin tubes and for controlling vend operations and change payout, said processor operable, for each change payout operation of the vending system, to determine the amount of change desired to be returned to a customer, to identify, if possible for a given change payout operation, at least one coin tube which is both full and stores a coin denomination type having a value less than or equal to the amount of change desired to be returned, wherein a coin may still be paid out from a coin tube which is not full, and, if at least one coin tube is identified, to produce one or more signals which first effect payout of a first coin from a preferred coin tube, said preferred coin tube being defined, primarily, as a coin tube which was identified as being both full and storing a coin denomination type having a value less than or equal to the amount of change desired to be returned.

38. A device in accordance with claim 37 wherein said processor is operable, if no coin tube is identified as both full and storing a coin denomination type having a value less than or equal to the amount desired to be returned, and secondarily, to effect payout of a first coin from a coin tube having (a) at least a minimal amount of coins therein, (b) the lowest valued coin denomination associated therewith the value of which is not evenly divisible into the value of the next higher valued coin denomination associated with a coin tube, and (c) a coin denomination associated therewith whose value is less than or equal to the amount desired to be returned.

39. The device of claim 37 wherein said preferred coin tube is further defined as a coin tube having associated therewith a coin denomination other than the highest valued denomination associated with one of the coin tubes.

40. Apparatus for controlling change payout in a vending machine having a plurality of coin tubes, each coin tube having one coin denomination type stored therein, at least one coin level sensor associated with each coin tube for generating a signal indicative of the coin tube being full, at least one gate which, when operated, diverts a deposited coin away from the plurality of coin tubes, said apparatus comprising a processor for processing data and controlling vend operations, said apparatus configured to:

(a) output a signal which effects operation of the gate when at least one coin tube is full and the denomination of a deposited coin is the same as the coin denomination associated with the full coin tube, (b) determine the amount of change ($CHANGE_{TOT}$) desired to be paid out during a vend operation; and (c) determine, based upon one or more signals from the vending machine, whether at least one predetermined condition is satisfied for a particular vend, said at least one predetermined condition at least including the condition that a least coin payout routine is disabled, and if said at least one predetermined condition is satisfied, to effect execution of a payout routine which includes steps in which the apparatus may:

(i) attempt to payout one coin from a coin tube that is full when the one coin has a value less than or equal to $CHANGE_{TOT}$; and (ii) if one coin is not paid out at step (c) (i), attempt to payout one coin having a value less than or equal to $CHANGE_{TOT}$ and having a value which cannot be evenly divided into the next highest value coin type.

41. Apparatus for controlling change payout in a vending machine having a plurality of coin tubes, each coin tube having one coin denomination type stored therein, at least one coin level sensor associated with each coin tube for generating a signal indicative of the coin tube being full, at least one gate which, when operated, diverts a deposited coin away from the plurality of coin tubes, said apparatus comprising a processor for processing data and controlling vend operations, said apparatus configured to:

(a) output a signal which effects operation of the gate when at least one coin tube is full and the denomination of a deposited coin is the same as the coin denomination associated with the full coin tube, (b) determine the amount of change ($CHANGE_{TOT}$) desired to be paid out during a vend operation;

(c) determine, based upon one or more signals from the vending machine, whether at least one predetermined condition is satisfied for a particular vend, and if said at least one predetermined condition is satisfied, to effect execution of a payout routine which includes steps in which the apparatus may:

(i) attempt to payout one coin from a coin tube that is full when the one coin has a value less than or equal to $CHANGE_{TOT}$; and (ii) if one coin is not paid out at step (c) (i), attempt to payout one coin having a value less than or equal to $CHANGE_{TOT}$ and having a value which cannot be evenly divided into the next highest value coin type;

(d) payout change using an alternative payout routine if said at least one predetermined condition of step (c) is not met.

42. Apparatus in accordance with claim 41, wherein the alternative payout routine is a least coin payout routine.

43. A method of paying out change from a vending machine, the vending machine having a plurality of coin tubes, each coin tube having one coin denomination type stored therein, the vending machine further including means for determining if each of said coin tubes is full, wherein a coin may still be paid out from a coin tube which is not full, said method comprising the steps of:

(a) determining the total amount of change payout ($CHANGE_{TOT}$) required;

(b) determining if one or more predetermined conditions are satisfied, said one or more predetermined conditions at least including the condition that a least coin payout routine be disabled; and (c) after step (b), and if each of said one or more predetermined conditions is satisfied:

(i) attempting to payout one coin having a value less than or equal to $CHANGE_{TOT}$ and stored in a coin tube that is full; and (ii) if one coin is not paid out at step (c) (i), attempting to payout one coin having a value less than or equal to $CHANGE_{TOT}$ and having a value which cannot be evenly divided into the next highest value coin type which is stored in a coin tube.

44. A method in accordance with claim 43 wherein an alternative payout routine is executed if each of said one or more predetermined conditions of step (b) is not met.

45. A method in accordance with claim 44 wherein the alternative payout routine is a least coin payout routine.

* * * * *

UNITED STATES PATENT AND TRADEMARK OFFICE

CERTIFICATE OF CORRECTION

PATENT NO. : 5,607,350

DATED : March 4, 1997

INVENTOR(S) : Joseph L. Levasseur and Ronald A. Hoormann

It is certified that error appears in the above-indentified patent and that said Letters Patent is hereby corrected as shown below:

On the title page, please add Item, [73]

--Assignee: Coin Acceptors, Inc.
St. Louis, Missouri--

Column 11, line 39, after the word "$CHANGE_{TOT}$" the word --and-- should be inserted.

Signed and Sealed this

Seventh Day of October, 1997

*Attest:*

*Attesting Officer*

Bruce Lehman

BRUCE LEHMAN

*Commissioner of Patents and Trademarks*